US005465788A

United States Patent [19]

Wright

[11] Patent Number: 5,465,788

[45] Date of Patent: Nov. 14, 1995

[54] TUBING STRING HANGING APPARATUS

[75] Inventor: Andrew Wright, Sherwood Park, Canada

[73] Assignee: 569,396 Alberta Ltd., Edmonton, Canada

[21] Appl. No.: 382,205

[22] Filed: Feb. 1, 1995

[51] Int. Cl.[6] ..... E21B 33/04; E21B 17/046

[52] U.S. Cl. ..... 166/78.1; 166/379; 166/380; 166/382

[58] Field of Search ..... 166/78, 382, 379, 166/380; 285/140

[56] References Cited

U.S. PATENT DOCUMENTS

| | | | |
|---|---|---|---|
| 1,650,102 | 11/1927 | Tschappat et al. | 166/78 |
| 1,662,984 | 3/1928 | Scott et al. | 166/78 |
| 2,294,061 | 8/1942 | Williamson | 166/78 |
| 2,471,198 | 5/1949 | Cormany | 166/78 |
| 2,595,434 | 5/1952 | Williams | 166/78 |
| 2,599,039 | 6/1952 | Baker | 166/78 |
| 2,630,181 | 3/1953 | Solum | 166/78 |
| 2,693,238 | 11/1954 | Baker | 166/78 |
| 2,788,073 | 4/1957 | Brown | 166/78 |
| 3,301,324 | 1/1967 | Smith | 166/78 UX |
| 3,494,638 | 2/1970 | Todd et al. | 285/93 |
| 5,139,090 | 8/1992 | Land | 166/369 |
| 5,388,639 | 2/1995 | Betcham et al. | 166/78 |

FOREIGN PATENT DOCUMENTS

| | | | |
|---|---|---|---|
| 896339 | 3/1972 | Canada | 166/47 |
| 91309001.5 | 4/1993 | European Pat. Off. . | |

OTHER PUBLICATIONS

RODEC Brochure, Canada, Aug. 1994.

Society of Petroleum Engineers Paper No. 23977, USA, Mar. 1992.

*Primary Examiner*—Stephen J. Novosad

*Attorney, Agent, or Firm*—Kvas Miller Everitt

[57] ABSTRACT

An apparatus for rotatably hanging a tubing string in the wellhead of a well casing. The apparatus includes a tubing hanger shell that has a mandrel rotatably mounted therein. The mandrel has upper and lower ends with the upper end connected to a tubing rotator and the lower end engaging a tubing string. To facilitate the connection and disengagement of the mandrel to the tubing rotator, a hollow sleeve is used to couple the parts together. The hollow sleeve is received within the mandrel and has longitudinal splines which engage corresponding splines on the mandrel to transfer rotational energy from the rotator to the mandrel. The rotator is removed from the mandrel through the application of force, and through movement, in a direction parallel to the longitudinal axis of the tubing string.

28 Claims, 4 Drawing Sheets

TUBING STRING HANGING APPARATUS

FIELD OF THE INVENTION

This invention relates to an apparatus for rotatably hanging a tubing string in a wellhead, such as is commonly used in the oil industry.

BACKGROUND OF THE INVENTION

For a variety of different reasons, oil wells are often not perfectly vertical. Meandering or deviated well bores cause engagement of the sucker rod with the inner wall surface of the production tubing string causing wear to the tubing string through movement of the sucker rod. After a length of time, the sucker rod will either wear through the side of the tubing string or reduce it to a point of failure under load.

To reduce the effects of wear caused when a sucker rod comes into contact with the inner surface of the tubing string, others have developed tubing rotators which slowly rotate the tubing string about the sucker rod to more evenly distribute wear around the inside circumference of the tubing string.

Although such rotating devices have been proven to be an effective means for extending the life of a tubing string, their use has resulted in additional production difficulties. First, tubing rotators are typically threaded onto the upper end of the tubing string thereby making it necessary to "lift" the entire string in order to service the rotator. Secondly, in deviated wells the tubing string may be subjected to non-vertical loading resulting in excessive frictional wear between the tubing string and the sucker rod, particularly toward the bottom of the tubing string. Furthermore, existing rotator and tubing string structures are commonly prone to "blow-back" wherein fluids are driven upwardly between the well casing and the tubing string resulting in leakage at the wellhead or loss of well control.

SUMMARY OF THE INVENTION

The invention therefore provides a tubing string hanger which overcomes the short falls of these prior devices through the incorporation of a structure which provides for full well control, accommodates vertical and non-vertical loading of the tubing string, and provides a means to hang the tubing string in the well casing while allowing a tubing rotator to be removed from the wellhead without having to pull or lift the tubing string from the well.

Accordingly, in one of its aspects the invention provides an apparatus for rotatably hanging a tubing string in a well casing having a wellhead, the apparatus comprising: a tubing hanger shell having means for engagement with said wellhead; a mandrel rotatably mounted within said tubing hanger shell, said mandrel having an upper end and a lower end, said lower end having engagement means for connection to said tubing string and said upper end engaging coupling means which connects said mandrel to a tubing rotator, said coupling means providing means to transfer rotational energy from said tubing rotator to said mandrel while allowing for the disengagement of said tubing rotator from said mandrel through the application of force, and through movement, in a direction parallel to the longitudinal axis of said tubing string; and bearing means disposed between said tubing hanger shell and said mandrel to facilitate in the rotation of said mandrel within said tubing hanger shell.

In another aspect, the present invention provides an apparatus for rotatably hanging a tubing string in a well casing having a wellhead, the apparatus comprising: a tubing hanger shell having means for engagement with said wellhead; a mandrel rotatably mounted within said tubing hanger shell, said mandrel having an internal tubing string pick-up thread and having an upper end and a lower end, said lower end having engagement means for connection to said tubing string; coupling means engaging said upper end of said mandrel and connecting said mandrel to a tubing rotator, said coupling means comprising a hollow sleeve threaded onto a rotor shaft of said tubing rotator and being received within said mandrel when said tubing rotator is connected to said mandrel, said hollow sleeve providing means to transfer rotational energy from said tubing rotator to said mandrel while allowing for the disengagement of said tubing rotator from said mandrel through the application of force, and through movement, in a direction parallel to the longitudinal axis of said tubing string; sealing means disposed between said tubing hanger shell and said wellhead, between said tubing hanger shell and said mandrel, and between said mandrel and said coupling means; and, bearing means disposed between said tubing hanger shell and said mandrel to facilitate in the rotation of said mandrel within said tubing hanger shell.

In still a further aspect the present invention provides an apparatus for rotatably hanging a tubing string in a well casing having a wellhead, the apparatus comprising: a tubing hanger shell for hanging said tubing string in said well casing, said tubing hanger shell having means for engagement with said wellhead; a mandrel rotatably mounted within said tubing hanger shell, said mandrel having an upper end and a lower end, said lower end having engagement means for connection to said tubing string and said upper end engaging coupling means for connection to a tubing rotator, said coupling means providing means to transfer rotational energy from said tubing rotator to said mandrel and allowing for the disengagement of said tubing rotator from said mandrel without appreciable rotational movement; and, bearing means disposed between said tubing hanger shell and said mandrel to facilitate in the rotation of said mandrel within said tubing hanger shell.

In an alternate embodiment the present invention provides an apparatus for rotatably hanging a tubing string in a well casing having a wellhead, the apparatus comprising: a tubing hanger shell having means for engagement with said wellhead; a mandrel rotatably mounted within said tubing hanger shell, said mandrel having an upper end and a lower end, said lower end having engagement means for connection to said tubing string and said upper end having a series of longitudinally oriented splines that engage corresponding splines on a shaft of a tubing rotator connected thereto, said splines on said mandrel and on said tubing rotator providing means to transfer rotational energy from said tubing rotator to said mandrel while allowing for the disengagement of said tubing rotator from said mandrel through the application of force, and through movement, in a direction parallel to the longitudinal axis of said tubing string; and, bearing means disposed between said tubing hanger shell and said mandrel to facilitate in the rotational movement of said mandrel within said tubing hanger shell.

BRIEF DESCRIPTION OF THE DRAWINGS

For a better understanding of the present invention, and to show more clearly how it may be carried into effect, reference will now be made, by way of example, to the accompanying drawings which show the preferred embodiments of the present invention in which.

DESCRIPTION OF THE PREFERRED EMBODIMENT

Figure 1:
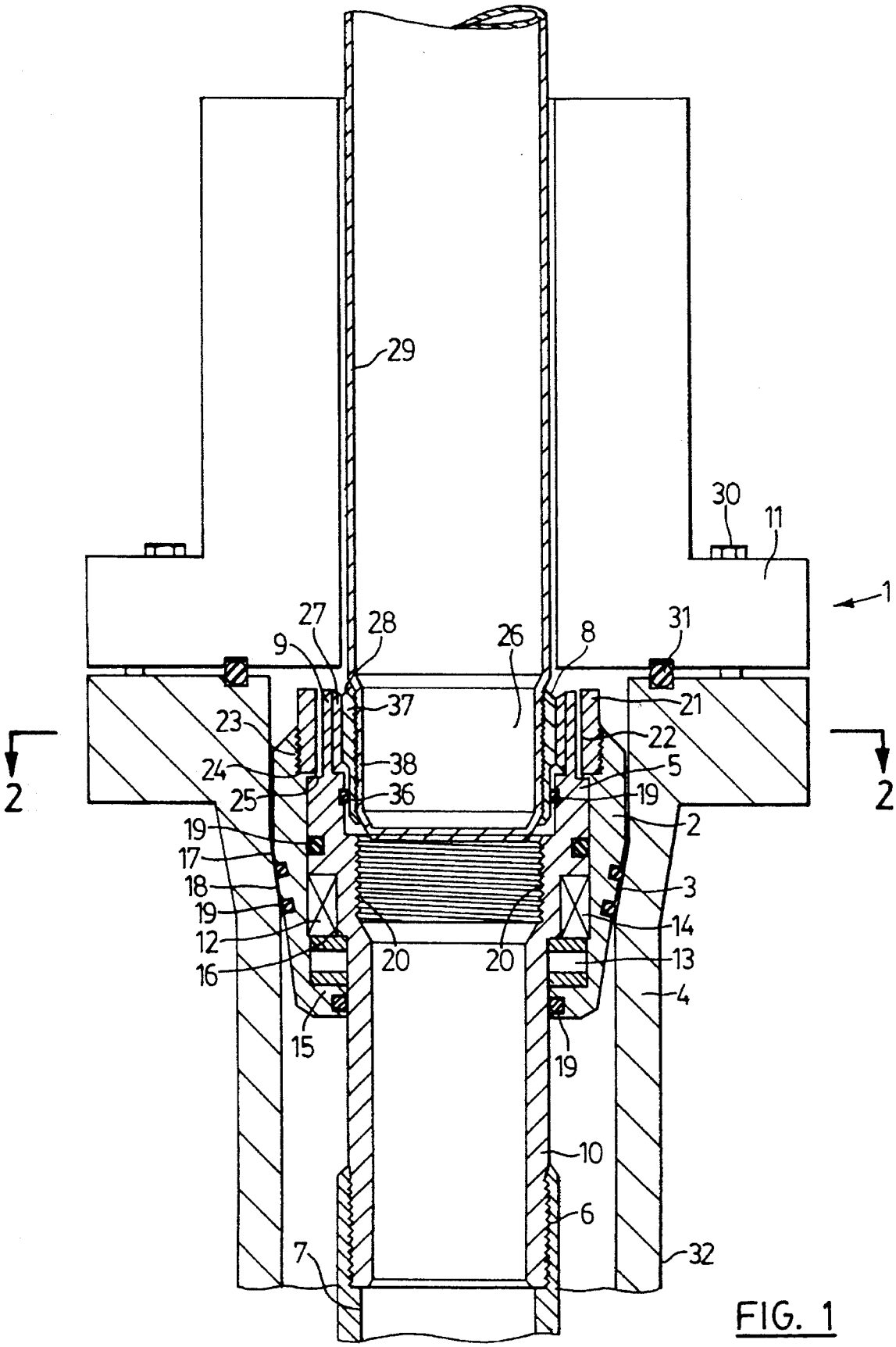
FIG. 1 is a side elevational view in longitudinal section of a tubing string hanger device in accordance with the present invention.
Figure 2:
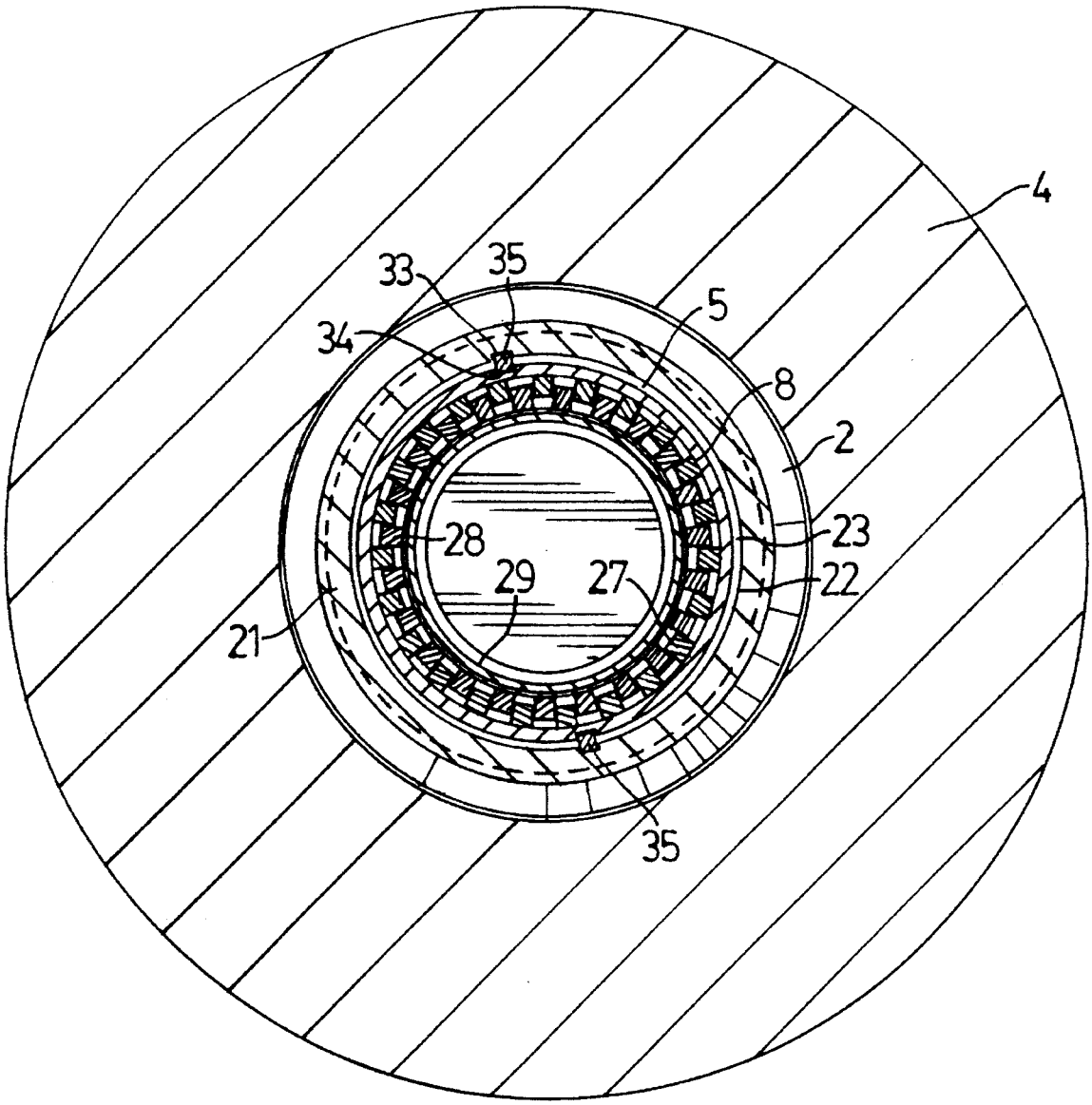
FIG. 2 is a sectional view of the device in FIG. 1 taken along the line 2—2.

Referring to FIGS. 1 and 2, a tubing string hanger pursuant to the present invention is generally noted by the numeral 1. The hanger apparatus 1 is comprised primarily of a tubing hanger shell 2 and a mandrel 5. As shown in FIG. 1, tubing shell hanger 2 has means 3 for engagement with a wellhead 4 of a well casing 32.

Mandrel 5 is rotatably mounted within tubing hanger shell 2 and has an upper end 9 and a bottom or lower end 10. Lower end 10 of mandrel 5 includes engagement means for connecting mandrel 5 to a tubing string 7. On its upper end 9, mandrel 5 engages a coupling means 8 which connects mandrel 5 to a tubing rotator 11. Coupling means 8 provides a means to transfer rotational energy from tubing rotator 11 to mandrel 5, and accordingly to tubing string 7. Coupling means 8 also allows for the disengagement or removal of tubing rotator 11 from mandrel 5, and the top of wellhead 4, without the need to pull or remove either mandrel 5 or tubing string 7 from the well. Through the use of hanger 1, tubing rotator 11 can also be removed without appreciable rotational movement of mandrel 5 and tubing string 7.

Referring to FIG. 1, hanger 1 includes bearing means 12 disposed between tubing hanger shell 2 and mandrel 5. Bearing means 12 facilitates in the rotation of mandrel 5 within tubing hanger shell 2 through a reduction in the friction between the respective parts. Bearing means 12 comprises both thrust bearings 13 and radial bearings 14. Thrust bearings 13 are situated between a lower shoulder 15 on tubing hanger shell 2 and an upper shoulder 16 on mandrel 5 such that the vertical loading of mandrel 5 is carried on thrust bearing 13 and transferred to tubing hanger shell 2.

As depicted in FIG. 1, radial bearings 14 are preferably positioned above thrust bearings 13. Radial bearings 14 facilitate in the rotational movement of mandrel 5 within tubing hanger shell 2 in deviated well situations, where mandrel 5 may be subjected to non-vertical loading.

In order to "hang" tubing string 7 within wellhead 4, means 3 for engagement with wellhead 4 preferably comprises an inwardly tapered exterior surface 17 on tubing hanger shell 2. Tapered surface 17 frictionally engages an inwardly tapered shoulder 18 on the interior surface of wellhead 4. Since the diameter of tubing hanger shell 2 is greater than the internal diameter of wellhead 4, tubing hanger shell 2 acts as a plug that holds mandrel 5, and consequentially tubing string 7, in position.

Though the vertical loading of mandrel 5, tubing hanger shell 2 is effectively seated against shoulder 18 and wellhead 4 forming a tight friction-fit. As is shown in FIG. 1, a series of sealing means 19, disposed between tubing hanger shell 2 and wellhead 4, between tubing hanger shell 2 and mandrel 5, and between mandrel 5 and coupling means 8, assist in preventing the leakage of fluid past hanger 1. In the preferred embodiment, sealing means 19 comprise O-ring seals.

To assist in the incorporation of mandrel 5 into a standard oil well environment employing a typical tubing string, engagement means 6 on the bottom of mandrel 5 preferably comprises a threaded portion for accepting a correspondingly threaded portion on tubing string 7. That is, in the preferred embodiment mandrel 5 would simply be threaded onto the upper end of the tubing string 7. In addition, to assist in the removal of tubing string 7 from wellhead 4 (ie. "pulling" the well), mandrel 5 preferably includes an internal tubing string pick-up thread 20. Pick-up thread 20 allows for mandrel 5 and tubing string 7 to be lifted from wellhead 4 through the use of a crane or lifting device connected to mandrel 5 by threading a shaft or pipe into pick-up threads 20.

To hold mandrel 5 within tubing hanger shell 2 retaining means 21 is utilized. Retaining means 21 would typically comprise a retaining nut that is threaded onto the top portion of tubing hanger shell 2. As shown in FIG. 1, the upper portion of tubing hanger shell 2 contains internal threads 22. Retaining nut 21 has corresponding external threads 23 such that it may be screwed downwardly into tubing hanger shell 2. When retaining nut 21 is threaded into tubing hanger shell 2, its lower surface 24 is positioned next to face 25 of mandrel 5 such that mandrel 5 is effectively held within tubing hanger shell 2 yet is still able to rotate freely. Furthermore, through adding torque to retaining nut 21 mandrel 5 is closely held within tubing hanger shell 2 regardless of the vertical or radial load supplied by tubing string 7. This structure also allows mandrel 5 to rotate freely in either direction while secured within hanger shell 2.

Retaining nut 21 has a further function in that it contains a longitudinally oriented keyway 33 that aligns with a corresponding keyway 34 on mandrel 5, as shown in FIG. 2. When retaining nut 21 is screwed into position into tubing hanger shell 2, keyways 33 and 34 align such that a key 35 may be inserted therein to prevent rotation of mandrel 5. In normal operation key 35 would not be used and mandrel 5 would be free to rotate. However, when it becomes necessary to lift the tubing string from the well, key 35 is inserted into aligned keyways 33 and 34 so that mandrel 5 is prevented from rotating. A shaft or pipe may then be threaded into pick-up threads 20 and the tubing string lifted from the well. Preferably more than one set of keyways 33 and 34 and more than one key 35 would be utilized. In FIG. 2, two such keyways and keys are shown.

In the operation of the preferred embodiment, mandrel 5 is screwed onto the top of tubing string 7 with tubing string 7 being positioned in the well casing. Tapered exterior surface 17 of tubing hanger shell 2 bears against inwardly tapered shoulder 18 of wellhead 4 to hold tubing hanger shell 2, and hence mandrel 5 and tubing string 7, securely within the wellhead. Retaining nut 21 secures mandrel 5 within tubing hanger shell 2. Tubing rotator 11 is then positioned over wellhead 4 such that coupling means 8 connects mandrel 5 to tubing rotator 11. Bolts 30 are typically used to hold tubing rotator 11 in place and a seal 31 helps to prevent leakage from between the rotator and the wellhead.

It will be appreciated that in order for tubing rotator 11 to be removed from wellhead 4 without the need to lift tubing string 7 from the well, coupling means 8 must allow for the disengagement of tubing rotator 11 without appreciable rotational movement. Where tubing rotator 11 has been threaded onto mandrel 5, to remove the rotator it is necessary to back-off or unscrew the rotator shaft in a direction opposite to which it was attached and unthread it from the mandrel. Subjecting mandrel 5 (and hence tubing string 7) to significant rotational movement in this "unthreading" direction could result in the loosening or undoing of threaded connections in the tubing string and loss of the string into the well.

Figure 3:
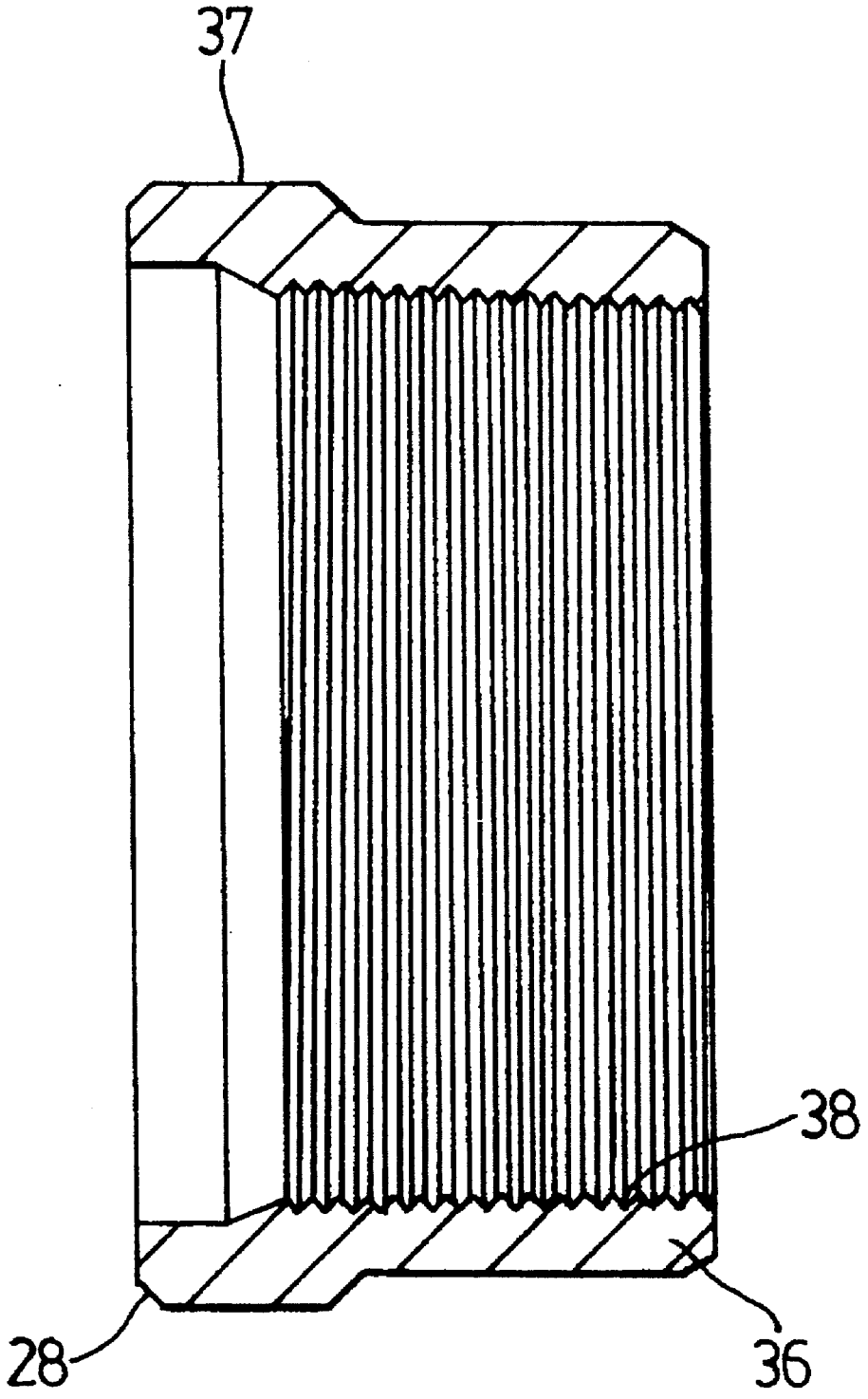
FIG. 3 is a side sectional view of the coupling means shown in FIG. 1.

As shown in FIGS. 1 and 3, coupling means 8 comprises a hollow sleeve 36 having external drive means 37 that engage mandrel 5. The interior surface of sleeve 36 contains threads 38 such that sleeve 36 may be threaded onto a rotor shaft 29 of rotator 11. In the preferred embodiment, drive means 37 comprises outwardly projecting splines 28 that engage corresponding spines 27 on mandrel 5.

Splines 27 and 28 are longitudinally oriented such that tubing rotator 11, with sleeve 36 threaded onto the lower end of shaft 29, may be connected to mandrel 5 through insertion of rotator shaft 29 into the upper end 9 of mandrel 5; splines 28 being received in the openings between splines 27. In this fashion, splines 28 bear against splines 27 upon rotation of rotator shaft 29 causing mandrel 5, and hence tubing string 7, to rotate. To facilitate the insertion of shaft 29 into mandrel 5, splines 27 and 28 are preferably of an involute configuration.

This structure allows for the rotational movement of mandrel 5 while still permitting the removal of tubing rotator 11 through lifting it off the wellhead without significant rotational movement and without running the risk of loosening threaded joints in the tubing string. There is therefore no need to lift the entire tubing string. While in most cases the removal or disengagement of tubing rotator 11 from mandrel 5 will require the application of a lifting force, and through motion, in an approximately vertical direction, it will be appreciated that in installations where a well casing is not vertical, tubing rotator 11 will be disengaged through the application of force, and through movement, in a direction parallel to the longitudinal axis of mandrel 5 and tubing string 7.

Although it may occasionally be necessary to slightly back-off tubing rotator 11 to disengage splines 28 from splines 27 when removing rotator 11 from the wellhead, the structure of splines 27 and 28 permit disengagement of rotator 11 without appreciable rotational movement. Any such backing-off that may be required will involve only a very slight reversing of rotator shaft 29 to disengage any significant frictional contact that may exist between splines 27 and 28. The structure of splines 27 and 28 enable them to readily slide past each other when removing rotator 11. Accordingly, there is no risk of loosening any threaded connections in the tubing string.

Figure 4:
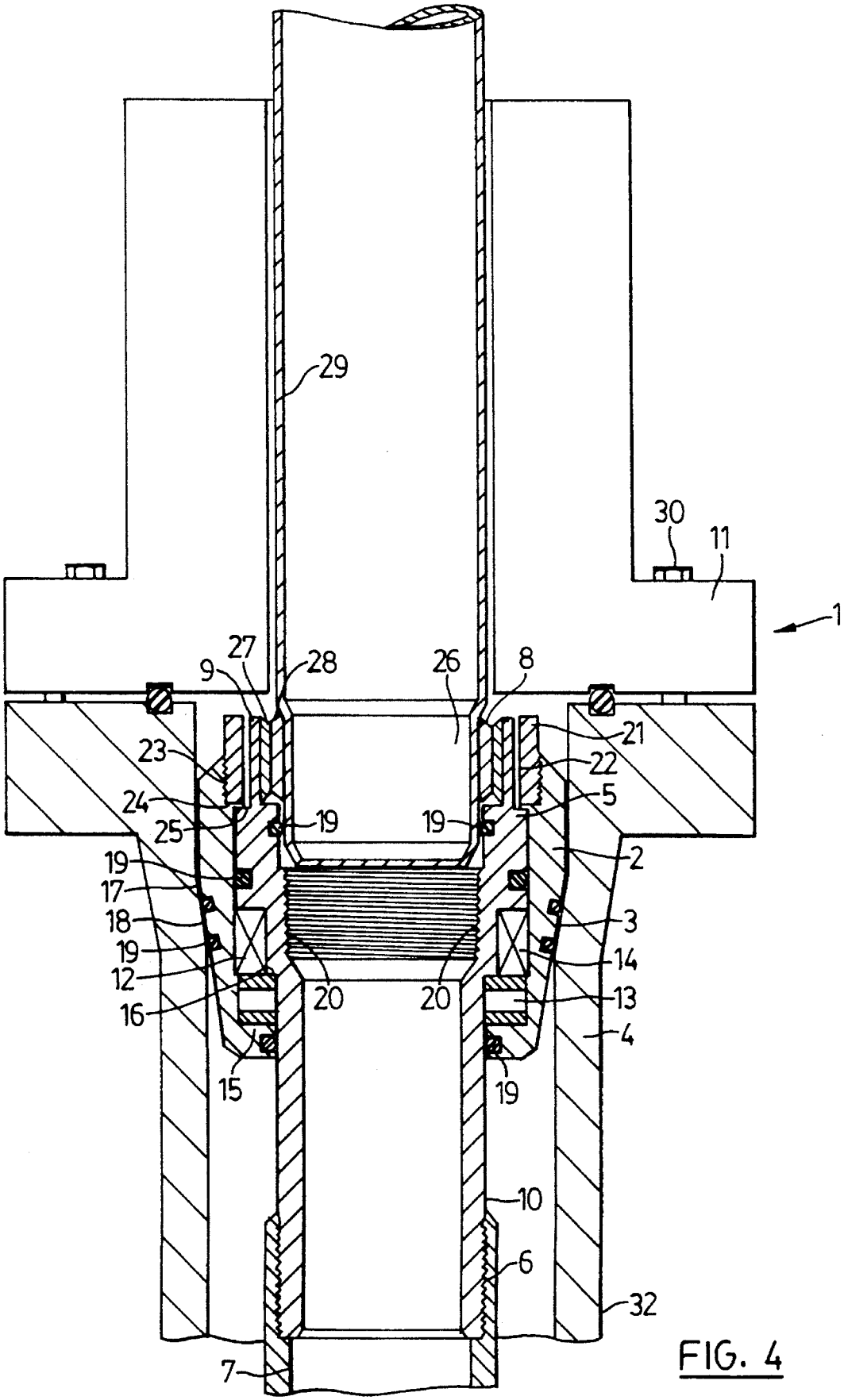
FIG. 4 is a side elevational view in longitudinal section of a tubing string hanger device in accordance with an alternate embodiment of the present invention.

In the alternate embodiment of the invention shown in FIG. 4, splines 28 project outwardly from the exterior surface of rotor shaft 29. Splines 28 engage splines 27 of mandrel 5 to permit rotation of mandrel 5, and to allow for the removal of tubing rotator 11, in the same manner as described above. The primary difference in this embodiment is that there is no requirement for sleeve 36 as splines 28 are formed directly on shaft 29.

It is to be understood that what has been described are the preferred embodiments of the invention and that it is possible to make variations to these embodiments while staying within the broad scope of the invention. Some of these variations have been discussed while others will be readily apparent to those skilled in the art. For example, while reference has been made to the use of splines 27 and 28, it will be appreciated that coupling means 8 could include other forms of connection means performing a similar function, including a pin and J-channel structure.

I claim:

1. An apparatus for rotatably hanging a tubing string in a well casing having a wellhead, the apparatus comprising:

a tubing hanger shell having means for engagement with said wellhead;

a mandrel rotatably mounted within said tubing hanger shell, said mandrel having an upper end and a lower end, said lower end having engagement means for connection to said tubing string and said upper end engaging coupling means which connects said mandrel to a tubing rotator, said coupling means providing means to transfer rotational energy from said tubing rotator to said mandrel while allowing for the disengagement of said tubing rotator from said mandrel through the application of force, and through movement, in a direction parallel to the longitudinal axis of said tubing string; and bearing means disposed between said tubing hanger shell and said mandrel to facilitate in the rotation of said mandrel within said tubing hanger shell.

2. The apparatus as claimed in claim 1 having sealing means disposed between said tubing hanger shell and said wellhead and between said tubing hanger shell and said mandrel.

3. The apparatus as claimed in claim 2 having further sealing means disposed between said mandrel and said coupling means.

4. The apparatus as claimed in claim 3 wherein said means on said tubing hanger shell for engagement with said wellhead comprises an inwardly tapered exterior surface that frictionally engages an inwardly tapered shoulder in said wellhead.

5. The apparatus as claimed in claim 4 wherein said sealing means and said frictional engagement of said tubing hanger shell with said wellhead prevent fluid leakage from between said wellhead and said tubing string.

6. The apparatus as claimed in claims 1 or 5 wherein said engagement means on said lower end of said mandrel comprises a threaded portion on said mandrel for accepting a correspondingly threaded portion on said tubing string.

7. The apparatus as claimed in claim 6 wherein said mandrel includes an internal tubing string pick-up thread.

8. The apparatus as claimed in claim 7 wherein the disengagement of said tubing rotator from said mandrel is accomplished without appreciable rotational movement.

9. The apparatus as claimed in claim 8 wherein said sealing means are O-rings.

10. The apparatus as claimed in claim 1 wherein said bearing means comprises thrust bearings to facilitate the rotational movement of said mandrel when said mandrel is subjected to vertical loading.

11. The apparatus as claimed in claim 10 wherein said bearing means further comprises radial bearings to facilitate the rotational movement of said mandrel when said wellhead and said well casing are inclined and said mandrel is subjected to nonvertical loading.

12. The apparatus as claimed in claim 1 wherein said coupling means comprises a hollow sleeve threaded onto a rotor shaft of said tubing rotator, said hollow sleeve on said rotor shaft being received within said mandrel when said tubing rotator is connected to said mandrel.

13. The apparatus as claimed in claim 12 wherein said hollow sleeve includes longitudinal splines which engage corresponding longitudinal splines on said mandrel, said rotational energy transferred from said tubing rotator to said mandrel through said engagement of said splines.

14. The apparatus as claimed in claim 13 wherein the disengagement of said tubing rotator from said mandrel is accomplished through the disengagement of said splines on said hollow sleeve from said splines on said mandrel and without appreciable rotational movement.

15. The apparatus as claimed in claim 14 wherein said splines on said mandrel and on said hollow sleeve are involute.

16. The apparatus as claimed in claim 1 including retaining means engageable with said tubing hanger shell to retain said mandrel within said tubing hanger shell.

17. The apparatus as claimed in claim 16 wherein said retaining means is a retaining nut.

18. The apparatus as claimed in claim 17 wherein said retaining nut includes a keyway, said keyway aligning with a corresponding keyway in said mandrel when said retaining nut is engaged with said tubing hanger shell, said keyway in said retaining nut and said keyway in said mandrel providing means for the insertion of a key therein to prevent rotation of said mandrel within said tubing hanger shell.

19. The apparatus as claimed in claim 17 having a plurality of keyways in said retaining nut and in said mandrel, said keyways in said retaining nut and in said mandrel aligning when said retaining nut is engaged with said tubing hanger shell, said keyways in said retaining nut and said keyways in said mandrel providing means for the insertion of a plurality of keys therein to prevent rotation of said mandrel within said tubing hanger shell.

20. The apparatus as claimed in claim 1 wherein said mandrel includes an internal tubing string pick-up thread.

21. An apparatus for rotatably hanging a tubing string in a well casing having a wellhead, the apparatus comprising:

a tubing hanger shell having means for engagement with said wellhead;

a mandrel rotatably mounted within said tubing hanger shell, said mandrel having an internal tubing string pick-up thread and having an upper end and a lower end, said lower end having engagement means for connection to said tubing string;

coupling means engaging said upper end of said mandrel and connecting said mandrel to a tubing rotator, said coupling means comprising a hollow sleeve threaded onto a rotor shaft of said tubing rotator and being received within said mandrel when said tubing rotator is connected to said mandrel, said hollow sleeve providing means to transfer rotational energy from said tubing rotator to said mandrel while allowing for the disengagement of said tubing rotator from said mandrel through the application of force, and through movement, in a direction parallel to the longitudinal axis of said tubing string;

sealing means disposed between said tubing hanger shell and said wellhead, between said tubing hanger shell and said mandrel, and between said mandrel and said coupling means; and, bearing means disposed between said tubing hanger shell and said mandrel to facilitate in the rotation of said mandrel within said tubing hanger shell.

22. An apparatus for rotatably hanging a tubing string in a well casing having a wellhead, the apparatus comprising:

a tubing hanger shell having means for engagement with said wellhead;

a mandrel rotatably mounted within said tubing hanger shell, said mandrel having an upper end and a lower end, said lower end having engagement means for connection to said tubing string and said upper end having a series of longitudinally oriented splines that engage corresponding splines on a shaft of a tubing rotator connected thereto, said splines on said mandrel and on said tubing rotator providing means to transfer rotational energy from said tubing rotator to said mandrel while allowing for the disengagement of said tubing rotator from said mandrel through the application of force, and through movement, in a direction parallel to the longitudinal axis of said tubing string; and, bearing means disposed between said tubing hanger shell and said mandrel to facilitate in the rotational movement of said mandrel within said tubing hanger shell.

23. The apparatus as claimed in claim 22 having sealing means disposed between said tubing hanger shell and said wellhead, and between said tubing hanger shell and said mandrel.

24. The apparatus as claimed in claim 23 including a retaining nut engageable with said tubing hanger shell to retain said mandrel within said tubing hanger shell.

25. The apparatus as claimed in claim 24 wherein said mandrel includes an internal tubing string pick-up thread.

26. An apparatus for rotatably hanging a tubing string in a well casing having a wellhead, the apparatus comprising:

a tubing hanger shell for hanging said tubing string in said well casing, said tubing hanger shell having means for engagement with said wellhead;

a mandrel rotatably mounted within said tubing hanger shell, said mandrel having an upper end and a lower end, said lower end having engagement means for connection to said tubing string and said upper end engaging coupling means for connection to a tubing rotator, said coupling means providing means to transfer rotational energy from said tubing rotator to said mandrel and allowing for the disengagement of said tubing rotator from said mandrel without appreciable rotational movement; and, bearing means disposed between said tubing hanger shell and said mandrel to facilitate in the rotation of said mandrel within said tubing hanger shell.

27. The apparatus as claimed in claim 26 having sealing means disposed between said tubing hanger shell and said wellhead, between said tubing hanger shell and said mandrel, and between said mandrel and said coupling means.

28. The apparatus as claimed in claim 27 wherein said mandrel includes an internal tubing string pick-up thread.

* * * * *

US005465788C1

(12) EX PARTE REEXAMINATION CERTIFICATE (5954th)

United States Patent
Wright

(10) Number: US 5,465,788 C1
(45) Certificate Issued: Oct. 23, 2007

(54) TUBING STRING HANGING APPARATUS

(75) Inventor: Andrew Wright, Sherwood Park (CA)

(73) Assignee: Robbins & Myers Canada, Ltd., Alberta (CA)

Reexamination Request:
No. 90/006,218, Feb. 12, 2002

Reexamination Certificate for:

| | |
|---|---|
| Patent No.: | **5,465,788** |
| Issued: | **Nov. 14, 1995** |
| Appl. No.: | **08/382,205** |
| Filed: | **Feb. 1, 1995** |

(51) Int. Cl.

| | |
|---|---|
| ***E21B 19/00*** | (2006.01) |
| ***E21B 19/16*** | (2006.01) |
| ***E21B 23/00*** | (2006.01) |

(52) U.S. Cl. ..... 166/78.1; 166/379; 166/380; 166/382

(58) Field of Classification Search ..... None
See application file for complete search history.

(56) References Cited

U.S. PATENT DOCUMENTS 1,650,102 A * 11/1927 Tschappat ..... 285/123.6
2,178,700 A 11/1939 Penick et al. ..... 166/14
5,383,519 A 1/1995 Wright et al. ..... 166/78
5,388,639 A * 2/1995 Betchan et al. ..... 166/85.1
5,429,188 A 7/1995 Cameron et al. ..... 166/78

* cited by examiner

*Primary Examiner*—Beverly M. Flanagan

(57) ABSTRACT

An apparatus for rotatably hanging a tubing string in the wellhead of a well casing. The apparatus includes a tubing hanger shell that has a mandrel rotatably mounted therein. The mandrel has upper and lower ends with the upper end connected to a tubing rotator and the lower end engaging a tubing string. To facilitate the connection and disengagement of the mandrel to the tubing rotator, a hollow sleeve is used to couple the parts together. The hollow sleeve is received within the mandrel and has longitudinal splines which engage corresponding splines on the mandrel to transfer rotational energy from the rotator to the mandrel. The rotator is removed from the mandrel through the application of force, and through movement, in a direction parallel to the longitudinal axis of the tubing string.

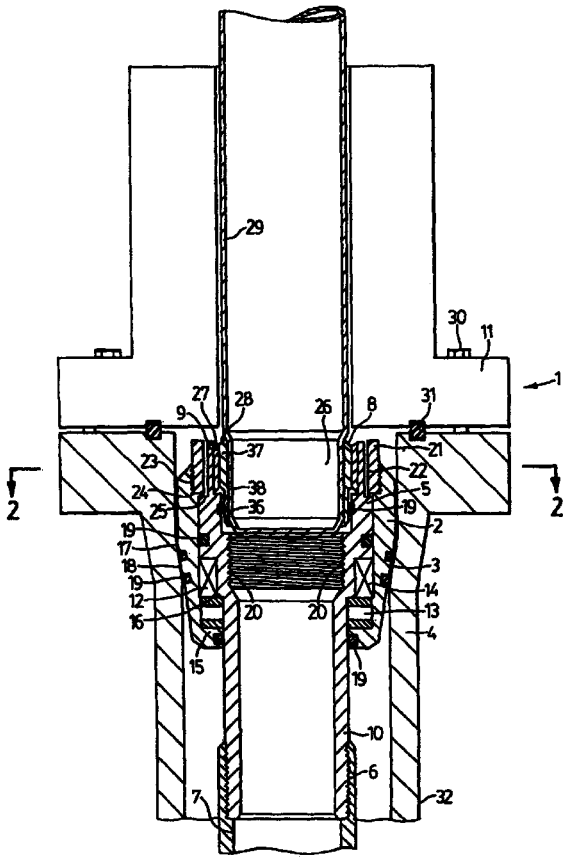

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claim 21 is confirmed.

Claim 27 is cancelled.

Claims 1, 22, 26 and 28 are determined to be patentable as amended.

Claims 2–20 and 23–25, dependent on an amended claim, are determined to be patentable.

New claims 29–123 are added and determined to be patentable.

1. An apparatus for rotatably hanging a tubing string in a well casing having a wellhead, the apparatus comprising:

a tubing hanger shell having means for engagement with said wellhead;

a mandrel rotatably mounted within said tubing hanger shell *about a central mandrel axis*, said mandrel having an upper end and a lower end, said lower end having engagement means for connection to said tubing string and said upper end engaging coupling means [which connects] *comprising a sleeve having longitudinal oriented force transfer surfaces on said sleeve to connect* said mandrel to a tubing rotator *with a rotational output positioned at least partially within a rotator housing with an output axis substantially parallel to said central mandrel axis for applying a rotational force to said mandrel*, said coupling means providing means to transfer rotational energy from said tubing rotator to said mandrel *upon rotation by said tubing rotator about said rotational output axis* while allowing for the disengagement of said tubing rotator from said mandrel through the application of force, and through movement, in a direction parallel to the longitudinal axis of said tubing string; and bearing means disposed between said tubing hanger shell and said mandrel to facilitate in the rotation of said mandrel within said tubing hanger shell.

22. An apparatus for rotatably hanging a tubing string in a well casing having a wellhead, the apparatus comprising:

a tubing hanger shell having means for engagement with said wellhead;

a mandrel rotatably mounted within said tubing hanger shell, said mandrel having an upper end and a lower end, said lower end having engagement means for connection to said tubing string and said upper end having a series of longitudinally oriented splines that engage corresponding splines on a *sleeve coupled to a* shaft of a tubing rotator *with a rotational output axis substantially parallel to a mandrel axis* connected thereto, said splines on said mandrel and on said tubing rotator providing means to transfer rotational energy from said tubing rotator to said mandrel while allowing for the disengagement of said tubing rotator from said mandrel through the application of force, and through movement, in a direction parallel to the longitudinal axis of said tubing string; and[,]

bearing means disposed between said tubing hanger shell and said mandrel to facilitate in the rotational movement of said mandrel within said tubing hanger shell.

26. An apparatus for rotatably hanging a tubing string in a well casing having a wellhead, the apparatus comprising:

a tubing hanger shell for hanging said tubing string in said well casing, said tubing hanger shell having means for engagement with said wellhead;

a mandrel rotatably mounted within said tubing hanger shell, *about a central mandrel axis,* said mandrel having an upper end and a lower end, said lower end having engagement means for connection to said tubing string and said upper end engaging coupling means *comprising a sleeve having longitudinal oriented force transfer surfaces on said sleeve* for connection to a tubing rotator *with a rotational output positioned at least partially within a rotator housing with an output axis substantially parallel to said central mandrel axis for applying a rotational force to said mandrel*, said coupling means providing means to transfer rotational energy from said tubing rotator to said mandrel *upon rotation by said tubing rotator about said rotational output axis* and allowing for the disengagement of said tubing rotator from said mandrel *upon axial movement of said tubing rotator substantially along said rotational axis* without appreciable rotational movement; and[,]

bearing means disposed between said tubing hanger shell and said mandrel to facilitate in the rotation of said mandrel within said tubing hanger shell.

28. The apparatus as claimed in claim [27] *26* wherein said mandrel includes an internal tubing string pick-up thread.

*29. An apparatus for rotatably hanging a tubing string in a well casing having a wellhead, the apparatus comprising:*

*a tubing hanger shell for hanging said tubing string in said well casing, said tubing hanger shell having means for engagement with said wellhead;*

*a mandrel rotatably mounted within said tubing hanger shell about a central mandrel axis, said mandrel having an upper end and a lower end, said lower end having engagement means for connection to said tubing string and said upper end engaging coupling means which connects said mandrel to a tubing rotator with a rotational output positioned at least partially within a rotator housing with an output axis substantially parallel to said central mandrel axis, said coupling means comprising a sleeve having a plurality of longitudinal oriented rotational force transfer surfaces on said sleeve circumferentially positioned about said rotational output axis for engagement with corresponding surfaces affixed to and positioned circumferentially about said mandrel, said coupling means providing means to transfer rotational energy from said tubing rotator to said mandrel upon rotation by said tubing rotator about said rotational output axis while allowing for the disengagement of said tubing rotator from said mandrel through the application of force, and through movement, in a direction parallel to the longitudinal axis of said tubing string; and*

*bearing means disposed between said tubing hanger shell and said mandrel to facilitate in the rotation of said mandrel within said tubing hanger shell, said tubing rotator having rotational output extending downward past an upper end of said mandrel.*

*30. The apparatus as claimed in claim 29, wherein each of said force transfer surfaces are configured to slide relative to said corresponding surfaces when said tubing rotator is removed from said wellhead.*

*31. The apparatus as claimed in claim 29, wherein one of said force transfer surfaces and said corresponding surfaces include a plurality of radial projections circumferentially positioned about said rotational output axis, and the other of said force transfer surfaces and said corresponding surfaces include a plurality of radial recesses circumferentially positioned about said mandrel, such that said radial recesses receive said radial projections.*

*32. The apparatus as claimed in claim 29, further comprising:*

*a first seal sealing between said tubing hanger shell and said mandrel; and*

*a second seal sealing between said mandrel and said coupling means.*

*33. The apparatus as claimed in claim 29, wherein said bearing means comprises:*

*a thrust bearing to facilitate rotation of said mandrel when subjected to vertical loading.*

*34. The apparatus as claimed in claim 29, further comprising:*

*a retaining nut for retaining the mandrel within the tubing hanger shell.*

*35. The apparatus should as shown in claim 29, wherein said tubing hanger shell includes an external surface for engagement with a shoulder on the wellhead, thereby supporting the tubing string in the well.*

*36. The apparatus as claimed in claim 29, further comprising:*

*an internal tubing string pick-up thread secured to said mandrel.*

*37. The apparatus as claimed in claim 29, wherein disengagement of said tubing rotator from said mandrel is accomplished without appreciable rotational movement.*

*38. The apparatus as claimed in claim 1, wherein said longitudinal oriented forces transfer surfaces includes a plurality of rotational force transfer surfaces circumferentially positioned about said rotational output axis for engagement with corresponding surfaces secured to and positioned circumferentially about said mandrel.*

*39. The apparatus as claimed in claim 38, wherein one of said force transfer surfaces and said corresponding surfaces include a plurality of radial projections circumferentially positioned about said rotational output axis, and the other of said force transfer surfaces and said corresponding surfaces include a plurality of radial recesses circumferentially positioned about said mandrel, such that said radial recesses receive said radial projections.*

*40. The apparatus as claimed in claim 38, wherein each of said force transfer surfaces are configured to slide relative to said corresponding surfaces when said tubing rotator is removed from said wellhead.*

*41. The apparatus as shown in claim 1, wherein said tubing hanger shell includes an external surface for engagement with a shoulder on the wellhead, thereby supporting the tubing string in the well.*

*42. The apparatus as claimed in claim 22, wherein the corresponding splines on the shaft of the tubing rotator include a plurality of rotational force transfer surfaces circumferentially positioned about said rotational output axis for engagement with corresponding surfaces secured to the mandrel and positioned circumferentially about the rotational output axis.*

*43. The apparatus as claimed in claim 42, wherein each of said force transfer surfaces are configured to slide relative to said corresponding surfaces when said tubing rotator is removed from said wellhead.*

*44. The apparatus as claimed in claim 42, wherein one of the said force transfer surfaces and said corresponding surfaces include a plurality of radial projections circumferentially positioned about said rotational output axis, and the other of said force transfer surfaces and said corresponding surfaces include a plurality of radial recesses circumferentially positioned about said rotational output axis, such that said radial recesses receive said radial projections.*

*45. The apparatus as claimed in claim 42, wherein said bearing means comprises:*

*a thrust bearing to facilitate rotation of said mandrel when subjected to vertical loading.*

*46. The apparatus as claimed in claim 42, further comprising:*

*a first seal sealing between said tubing hanger shell and said mandrel; and*

*a second seal sealing between said mandrel and coupling means.*

*47. The apparatus as claimed in claim 42, wherein said tubing hanger shell includes an external surface for engagement with a shoulder on the wellhead, thereby supporting the tubing string in the well.*

*48. The apparatus as claimed in claim 42, wherein disengagement of said tubing rotator from said mandrel is accomplished without appreciable rotational movement.*

*49. The apparatus as claimed in claim 26, wherein the tubing rotator includes a plurality of rotational force transfer surfaces circumferentially positioned about said rotational output axis for engagement with corresponding surfaces secured to and positioned circumferentially about said mandrel.*

*50. The apparatus as claimed in claim 49, wherein each of said force transfer surfaces are configured to slide relative to said corresponding surfaces when said tubing rotator is removed from said wellhead.*

*51. The apparatus as claimed in claim 26, wherein said tubing hanger shell includes an external surface for engagement with a shoulder on the wellhead, thereby supporting the tubing string in the well.*

*52. The apparatus as claimed in claim 26, wherein said bearing means comprises:*

*a thrust bearing to facilitate rotation of said mandrel when subjected to vertical loading.*

*53. The apparatus as claimed in claim 26, further comprising:*

*a first seal sealing between said tubing hanger shell and said mandrel; and*

*a second seal sealing between said mandrel and said coupling means.*

*54. The apparatus as claimed in claim 26, wherein disengagement of said tubing rotator from said mandrel is accomplished without appreciable rotational movement.*

*55. An apparatus for rotatably hanging a tubing string in a well casing having a wellhead, the apparatus comprising:*

*a tubing hanger shell having means for engagement with said wellhead;*

*a mandrel rotatably mounted within said tubing hanger shell, said mandrel having an upper end and a lower*

*end, said lower end having engagement means for connection to said tubing string and said upper end engaging coupling means which connects said mandrel to a tubing rotator, said coupling means comprising a sleeve secured to a shaft of said tubing rotator and proving means to transfer rotational energy from said tubing rotator to said mandrel while a rotational output from said tubing rotator is stationary relative to said mandrel and allowing for the disengagement of said tubing rotator from said mandrel through the application of force, and through movement in a direction parallel to the longitudinal axis of said tubing string; and,*

*bearing means disposed between said tubing hanger shell and said mandrel to facilitate in the rotation of said mandrel within said tubing hanger shell.*

*56. The apparatus as claimed in claim 55, wherein said coupling means has a plurality of rotational force transfer surfaces circumferentially positioned about a rotational output axis for engagement with corresponding surfaces affixed to and positioned circumferentially about said mandrel.*

*57. The apparatus as claimed in claim 56, wherein each of said force transfer surfaces are configured to slide relative to said corresponding surfaces when said tubing rotator is removed from said wellhead.*

*58. The apparatus as claimed in claim 56, wherein one of said force transfer surfaces and said corresponding surfaces include a plurality of radial projections circumferentially positioned about said rotational output axis, and the other of said force transfer surfaces and said corresponding surfaces include a plurality of radial recesses circumferentially positioned about said mandrel, such that said radial recesses receive said radial projections.*

*59. The apparatus as claimed in claim 55, wherein said coupling means includes a rotational force transfer surface radially spaced from a rotational output axis for engagement with a corresponding surface affixed to said mandrel.*

*60. The apparatus as claimed in claim 55, wherein said tubing hanger shell includes an external surface for engagement with a shoulder on the wellhead, thereby supporting the tubing string in the well.*

*61. The apparatus as claimed in claim 55, further comprising:*

*a first seal sealing between said tubing hanger shell and said mandrel; and*

*a second seal sealing between said mandrel and said coupling means.*

*62. The apparatus as claimed in claim 55, wherein said bearing means comprises:*

*a thrust bearing to facilitate rotation of said mandrel when subjected to vertical loading.*

*63. The apparatus as claimed in claim 55, further comprising:*

*an internal tubing string pick-up thread secured to said mandrel.*

*64. The apparatus as claimed in claim 55, further comprising:*

*a retaining nut for retaining the mandrel within the tubing hanger shell.*

*65. The apparatus as claimed in claim 55, wherein disengagement of said tubing rotator from said mandrel is accomplished without appreciable rotational movement.*

*66. The apparatus as claimed in claim 46, wherein the coupling means includes a sleeve having the longitudinally oriented force transfer surfaces.*

*67. An apparatus for rotatably hanging a tubing string in a well casing having a wellhead, the apparatus comprising:*

*a tubing hanger shell having means for engagement with said wellhead;*

*a mandrel rotatably mounted within said tubing hanger shell, said mandrel having an upper end and a lower end, said lower end having engagement means for connection to said tubing string and said upper end engaging coupling means which connects said mandrel to a tubing rotator, said coupling means providing means to transfer rotational energy from said tubing rotator to said mandrel while allowing for the disengagement of said tubing rotator from said mandrel through the application of force, and through movement, in a direction parallel to the longitudinal axis of said tubing string;*

*bearing means disposed between said tubing hanger shell and said mandrel to facilitate in the rotation of said mandrel within said tubing hanger shell;*

*sealing means disposed between said tubing hanger shell and said wellhead and between said tubing hanger shell and said mandrel; and*

*further sealing means disposed between said mandrel and said coupling means.*

*68. The apparatus as claimed in claim 67, wherein said means on said tubing hanger shell for engagement with said wellhead comprises an inwardly tapered exterior surface that frictionally engages an inwardly tapered shoulder in said wellhead.*

*69. The apparatus as claimed in claim 67, wherein said engagement means on said lower end of said mandrel comprises a threaded portion on said mandrel for accepting a corresponding threaded portion on said tubing string.*

*70. The apparatus as claimed in claim 67, wherein said mandrel includes an internal tubing string pick-up thread.*

*71. The apparatus as claimed in claim 67, wherein the disengagement of said tubing rotator from said mandrel is accomplished without appreciable rotational movement.*

*72. The apparatus as claimed in claim 67, wherein said bearing means comprises thrust bearings to facilitate the rotational movement of said mandrel when said mandrel is subjected to vertical loading.*

*73. The apparatus as claimed in claim 67, including retaining means engageable with said tubing hanger shell to retain said mandrel within said tubing hanger shell.*

*74. The apparatus as shown in claim 67, wherein said tubing hanger shell includes an external surface for engagement with a shoulder on the wellhead, thereby supporting the tubing string in the well.*

*75. The apparatus as shown in claim 67, wherein said coupling means includes longitudinal oriented force transfer surfaces to connect said mandrel to an output of said tubing rotator which has an axis substantially parallel to said central mandrel axis.*

*76. The apparatus as shown in claim 75, wherein said force transfer surfaces includes a plurality of radial projections circumferentially positioned about the rotationable output axis, and a plurality of radial recesses circumferentially positioned about said rotational output axis, such that radial recesses of one of said mandrel and said output of said tubing rotator receive radial projections on the other of said mandrel and said tubing rotator.*

*77. An apparatus for rotatably hanging a tubing string in a well casing having a wellhead, the apparatus comprising:*

*a tubing hanger shell for hanging said tubing string in said well casing, said tubing hanger shell having means for engagement with said wellhead;*

*a mandrel rotatably mounted within said tubing hanger shell, about a central mandrel axis, said mandrel having an upper end and a lower end, said lower end having engagement means for connection to said tubing string and said upper end engaging coupling means comprising a sleeve having longitudinal oriented force transfer surfaces on said sleeve for connection to a tubing rotator with a rotational output positioned at least partially within a rotator housing with an output axis substantially parallel to said central mandrel axis for applying a rotational force to said mandrel, said coupling means providing means to transfer rotational energy from said tubing rotator to said mandrel upon rotation by said tubing rotator about said rotational output axis and allowing for the disengagement of said tubing rotator from said mandrel upon axial movement of said tubing rotator substantially along said rotational output axis without appreciable rotational movement;*

*bearing means disposed between said tubing hanger shell and said mandrel to facilitate in the rotation of said mandrel within said tubing hanger shell, and*

*sealing means disposed between said tubing hanger shell and said wellhead, between said tubing hanger shell and said mandrel, and between said mandrel and said coupling means.*

*78. The apparatus as claimed in claim 77, wherein said mandrel includes an internal tubing string pick-up thread.*

*79. The apparatus as claimed in claim 77, wherein said tubing hanger shell includes an external surface for engagement with a shoulder on the wellhead, thereby supporting the tubing string in the well.*

*80. The apparatus as claimed in claim 77, wherein said bearing means comprises:*

*a thrust bearing to facilitate rotation of said mandrel when subjected to vertical loading.*

*81. The apparatus as claimed in claim 77, wherein said means on said tubing hanger shell for engagement with said wellhead comprises an inwardly tapered exterior surface that frictionally engages an inwardly tapered shoulder in said wellhead.*

*82. The apparatus as claimed in claim 77, wherein said engagement means on said lower end of said mandrel comprises a threaded portion on said mandrel for accepting a correspondingly threaded portion on said tubing string.*

*83. The apparatus as claimed in claim 77, wherein the disengagement of said tubing rotator from said mandrel is accomplished without appreciable rotational movement.*

*84. The apparatus as shown in claim 77, wherein said coupling means includes longitudinal oriented force transfer surfaces to connect said mandrel to an output of said tubing rotator which has an axis substantially parallel to said central mandrel axis.*

*85. The apparatus as shown in claim 84, wherein said force transfer surfaces includes a plurality of radial projections circumferentially positioned about the rotationable output axis, and a plurality of radial recesses circumferentially positioned about said rotational output axis, such that radial recesses of one of said mandrel and said output of said tubing rotator receive radial projections on the other of said mandrel and said tubing rotator.*

*86. An apparatus for rotatably hanging a tubing string in a well casing having a wellhead, the apparatus comprising:*

*a tubing hanger shell having an engagement surface for engagement with said wellhead;*

*a mandrel rotatably mounted within said tubing hanger shell and rotatable about a mandrel central axis, said mandrel having an upper end and a lower end, said lower end adapted for connection to said tubing string and said upper end engaging a coupling member supported on a tubing rotator, said coupling member having longitudinally oriented force transfer surfaces on said coupling member circumferentially about said mandrel central axis to connect said mandrel to said tubing rotator, said tubing rotator having a lower end for supporting on a top of said wellhead and a rotational output member rotatable with said coupling member, said coupling member transferring ratational energy from said tubing rotator to said mandrel upon rotation of said coupling member by said tubing rotator while allowing for the disengagement of said coupling member with said tubing rotator from said mandrel through movement in a direction substantially parallel to the mandrel central axis, thereby disengaging the lower end of said tubing rotator and the top of the wellhead; and*

*a bearing disposed between said tubing hanger shell and said mandrel to facilitate the rotation of said mandrel within said tubing hanger shell.*

*87. The apparatus as claimed in claim 86, further comprising:*

*a first seal between said tubing hanger shell and said wellhead and a second seal between said tubing hanger shell and said mandrel.*

*88. The apparatus as claimed in claim 87, further comprising:*

*a third seal between said mandrel and said coupling member.*

*89. The apparatus as claimed in claim 86, wherein said coupling member comprises a hollow sleeve detachable from said rotational output member.*

*90. The apparatus as claimed in claim 86, wherein said engagement surface on said tubing hanger shell for engagement with said wellhead comprises an inwardly tapered exterior surface that frictionally engages an inwardly tapered shoulder on said wellhead.*

*91. The apparatus as claimed in claim 86, wherein said lower end of said mandrel comprises a threaded portion on said mandrel for accepting a correspondingly threaded portion on said tubing string.*

*92. The apparatus as claimed in claim 86, wherein said mandrel includes an internal tubing string pick-up thread.*

*93. The apparatus as claimed in claim 86, wherein said bearing member comprises a thrust bearing to facilitate the rotational movement of said mandrel when said mandrel is subjected to vertical loading.*

*94. The apparatus as claimed in claim 93, wherein said bearing member further comprises a radial bearing to facilitate the rotational movement of said mandrel when subjected to nonvertical loading.*

*95. The apparatus as claimed in claim 86, wherein said coupling member comprises a hollow sleeve secured to said rotational output member and supporting said longitudinally oriented force transfer surfaces.*

*96. The apparatus as claimed in claim 95, wherein said coupling member includes longitudinal splines which engage corresponding longitudinal splines on said mandrel, said rotational energy transferred from said tubing rotator to said mandrel through said engagement of said splines.*

*97. The apparatus as claimed in claim 86, further comprising:*

*a retainer engageable with said tubing hanger shell to retain said mandrel within said tubing hanger shell.*

*98. An apparatus for rotatably hanging a tubing string in a well casing having a wellhead, the apparatus comprising:*

*a tubing hanger shell having an engagement member for engagement with said wellhead;*

*a mandrel rotatably mounted within said tubing hanger shell, said mandrel having an upper end and a lower end, said lower end adapted for connection to said tubing string and said upper end having a series of longitudinally oriented splines supported circumferentially on the mandrel that engage corresponding splines supported circumferentially on an output shaft of a tubing rotator, said tubing rotator having a lower end for supporting on a top of said wellhead, and said output shaft having a rotational output axis substantially parallel to a mandrel axis, said splines on said upper end of said mandrel and said corresponding splines on said output shaft are rotatably secured to the splines on the mandrel to transfer rotational energy from said tubing rotator to said mandrel while allowing for the disengagement of said corresponding splines with said tubing rotator from said mandrel through movement in a direction substantially parallel to the mandrel central axis, thereby disengaging said lower end of said tubing rotator and the top of the wellhead; and*

*a bearing disposed between said tubing hanger shell and said mandrel to facilitate the rotational movement of said mandrel within said tubing hanger shell.*

*99. The apparatus as claimed in claim 98, further comprising:*

*a first seal between said tubing hanger shell and said wellhead and a second seal between said tubing hanger shell and said mandrel.*

*100. The apparatus as claimed in claim 98, wherein said corresponding splines are rotatably secured to said output shaft of said tubing rotator.*

*101. The apparatus as claimed in claim 98, wherein said material includes an internal tubing string pick-up thread.*

*102. An apparatus for rotatably hanging a tubing string in a well casing having a wellhead, the apparatus comprising:*

*a tubing hanger shell having means for engagement with said wellhead;*

*a mandrel rotatably mounted within said tubing hanger shell, said mandrel having an upper end and a lower end, said lower end having engagement means for connection to said tubing string and said upper end engaging a coupling member which connects said mandrel to a tubing rotator, said coupling member comprising a hollow sleeve having one or more drive surfaces engaged with corresponding surfaces on said mandrel to transfer rotational energy from said tubing rotator to said mandrel while allowing for the disengagement of said tubing rotator from said mandrel through the application of force, and through movement, in a direction parallel to the longitudinal axis of said tubing string;*

*bearing means disposed between said tubing hanger shell and said mandrel to facilitate in the rotation of said mandrel within said tubing hanger shell; and*

*a seal between said mandrel and said coupling member.*

*103. An apparatus as in claim 102, wherein said coupling member is supported on said tubing rotator for movement therewith along a longitudinal axis of said mandrel to allow for the disengagement of said coupling member with said tubing rotator from said mandrel through movement of said tubing rotator in a direction parallel to the longitudinal axis of said mandrel.*

*104. An apparatus as in claim 102, wherein said drive surfaces comprise longitudinally oriented splines.*

*105. An apparatus as in claim 102, further comprising:*

*another second seal between said tubing hanger shell and said mandrel.*

*106. An apparatus as in claim 102, wherein said lower end of said mandrel comprises a threaded portion on said mandrel for accepting a correspondingly threaded portion on said tubing string.*

*107. The apparatus as claimed in claim 102, wherein said mandrel includes an internal tubing string pick-up thread.*

*108. An apparatus for rotatably hanging a tubing string in a well casing having a wellhead, the apparatus comprising:*

*a tubing hanger shell having means for engagement with said wellhead;*

*a mandrel rotatably mounted within said tubing hanger shell, said mandrel having an upper end and a lower end, said lower end having engagement means for connection to said tubing string and said upper end having a series of longitudinally oriented splines that engage corresponding splines on a shaft of a tubing rotator connected thereto, said splines on said mandrel and on said tubing rotator shaft transfer rotational energy from said tubing rotator to said mandrel while allowing for the disengagement of said tubing rotator from said mandrel through the application of force, and through movement, in a direction parallel to the longitudinal axis of said tubing string;*

*bearing means disposed between said tubing hanger shell and said mandrel to facilitate in the rotational movement of said mandrel within said tubing hanger shell; and*

*a seal between said mandrel and said tubing rotator shaft.*

*109. An apparatus as in claim 108, further comprising:*

*a second seal between said tubing hanger shell and said mandrel.*

*110. The apparatus as claimed in claim 108, wherein said lower end of said mandrel comprises a threaded portion on said mandrel for accepting a correspondingly threaded portion on said tubing string.*

*111. The apparatus as claimed in claim 108, wherein said mandrel includes an internal tubing string pick-up thread.*

*112. The apparatus as claimed in claim 108, further comprising:*

*a retainer engageable with said tubing hanger shell to retain said mandrel within said tubing hanger shell.*

*113. An apparatus for rotatably hanging a tubing string in a well casing having a wellhead, the apparatus comprising:*

*a tubing hanger shell having means for engagement with said wellhead;*

*a mandrel rotatably mounted within said tubing hanger shell, said mandrel having an upper end and a lower end, said lower end having engagement means for connection to said tubing string and said upper end engaging a coupling member which connects said mandrel to a tubing rotator, said coupling member detachably engaged with said tubing rotator and comprising a hollow sleeve having a drive surface engaged with a corresponding surface on said mandrel to transfer rotational energy from said tubing rotator to said mandrel, wherein said coupling member is secured to said tubing rotator for movement therewith along a longitudinal axis of said mandrel to allow for the disengagement of said coupling member and said tubing rotator, together, from said mandrel through the*

*application of force, and through movement of said tubing rotator, in a direction parallel to the longitudinal axis of said mandrel and said tubing string; and*

*bearing means disposed between said tubing hanger shell and said mandrel to facilitate in the rotation of said mandrel within said tubing hanger shell.*

*114. The apparatus as claimed in claim 113, further comprising:*

*a first seal between said tubing hanger shell and said wellhead and a second seal between said tubing hanger shell and said mandrel.*

*115. The apparatus as claimed in claim 113, wherein said lower end of said mandrel comprises a threaded portion on said mandrel for accepting a correspondingly threaded portion on said tubing string.*

*116. The apparatus as claimed in claim 113, wherein said bearing member comprises a thrust bearing to facilitate the rotational movement of said mandrel when said mandrel is subjected to vertical loading.*

*117. The apparatus as claimed in claim 113, wherein said coupling member includes longitudinal splines which engage corresponding longitudinal splines on said mandrel, said rotational energy transferred from said tubing rotator to said mandrel through said engagement of said splines.*

*118. The apparatus as claimed in claim 113, wherein said mandrel includes an internal tubing string pick-up thread.*

*119. An apparatus for rotatably hanging a tubing string in a well casing having a wellhead, the apparatus comprising:*

*a tubing hanger shell having means for engagement with said wellhead;*

*a tubing rotator comprising a housing and a rotator shaft rotatably mounted within said housing;*

*a mandrel rotatably mounted within said tubing hanger shell, said mandrel having an axis of rotation substantially parallel to the axis of rotation of said rotator shaft, said mandrel further comprising an upper end and a lower end, said lower end having engagement means for connection to said tubing string and said upper end having a series of longitudinally oriented splines that engage corresponding splines on said rotator shaft connected thereto, said splines on said mandrel and on said rotator shaft transferring rotational energy from said rotator shaft to said mandrel while allowing for the disengagement of said tubing rotator shaft and housing, together, from said mandrel through the application of force, and through movement of said tubing rotator housing in a direction parallel to the longitudinal axis of said mandrel and said tubing string; and*

*bearing means disposed between said tubing hanger shell and said mandrel to facilitate in the rotational movement of said mandrel within said tubing hanger shell.*

*120. The apparatus as claimed in claim 119, further comprising:*

*a first seal between said tubing hanger shell and said wellhead and a second seal between said tubing hanger shell and said mandrel.*

*121. The apparatus as claimed in claim 119, wherein said lower end of said mandrel comprises a threaded portion on said mandrel for accepting a correspondingly threaded portion on said tubing string.*

*122. The apparatus as claimed in claim 119, wherein said bearing member comprises a thrust bearing to facilitate the rotational movement of said mandrel when said mandrel is subjected to vertical loading.*

*123. The apparatus as claimed in claim 119, wherein said coupling member includes longitudinal splines which engage corresponding longitudinal splines on said mandrel, said rotational energy transferred from said tubing rotator to said mandrel through said engagement of said splines.*

* * * * *